US007214175B2

(12) United States Patent
Janzen

(10) Patent No.: US 7,214,175 B2
(45) Date of Patent: May 8, 2007

(54) FOLDING GEAR COMPRISING A CYLINDER WITH ADJUSTABLE CIRCUMFERENCE

(75) Inventor: Igor Janzen, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 498 days.

(21) Appl. No.: 10/488,937

(22) PCT Filed: Sep. 28, 2002

(86) PCT No.: PCT/DE02/03684

§ 371 (c)(1),
(2), (4) Date: Mar. 16, 2004

(87) PCT Pub. No.: WO03/031303

PCT Pub. Date: Apr. 17, 2003

(65) Prior Publication Data

US 2005/0001370 A1 Jan. 6, 2005

(30) Foreign Application Priority Data

Oct. 1, 2001 (DE) ..... 101 48 503

(51) Int. Cl.
*B31B 1/26* (2006.01)

(52) U.S. Cl. ..... 493/476; 493/424; 493/425; 493/427; 493/428; 493/432; 493/434; 493/442; 493/471; 493/479; 83/38; 83/313; 270/43

(58) Field of Classification Search ..... 270/43; 493/425, 432, 471, 476, 479, 424, 427, 428, 493/434, 442; 83/38, 313

See application file for complete search history.

(56) References Cited

U.S. PATENT DOCUMENTS

| | | | | |
|---|---|---|---|---|
| 3,882,745 | A * | 5/1975 | Garrett et al. | 83/311 |
| 3,952,637 | A * | 4/1976 | Lambert et al. | 493/30 |
| 4,736,660 | A * | 4/1988 | Benach et al. | 83/174 |
| 4,895,356 | A | 1/1990 | Rudolf | |
| 4,936,561 | A | 6/1990 | Mukai | |
| 5,039,076 | A * | 8/1991 | Fischer | 270/47 |
| 5,122,109 | A * | 6/1992 | Kubota et al. | 493/427 |
| 5,201,701 | A * | 4/1993 | Roettger et al. | 493/425 |
| 5,313,883 | A | 5/1994 | DiGenova | |

(Continued)

FOREIGN PATENT DOCUMENTS

| | | |
|---|---|---|
| DE | 2 157 615 | 5/1973 |
| DE | 25 30 365 | 9/1978 |
| DE | 37 26 239 A1 | 2/1989 |
| DE | 39 06 975 A1 | 9/1990 |
| DE | 4103160 A1 | 6/1992 |

(Continued)

OTHER PUBLICATIONS

"Harmonic Drive Brochure," Harmonic Drive Systems, Inc.; pp. 1-59; Feb. 1994.

*Primary Examiner*—Gene O. Crawford
*Assistant Examiner*—Leslie A. Nicholson, III
(74) *Attorney, Agent, or Firm*—Jones Tullar Cooper, PC

(57) ABSTRACT

A folding gear is comprised of a cylinder that is mounted to a frame for rotation. At least one clamp is arranged on the outer surface of the cylinder. The at least one clamp can be positioned by an actuator which includes a flexible toothed shell that is shaped by a non-circular section of a shaft. A hollow gear engages this flexible shell and cooperates with it to form a harmonic drive gear.

22 Claims, 10 Drawing Sheets

U.S. PATENT DOCUMENTS

| | | | | |
|---|---|---|---|---|
| 5,732,944 | A * | 3/1998 | Mayer | 271/265.01 |
| 6,004,242 | A | 12/1999 | Kostiza | |
| 6,398,704 | B1 | 6/2002 | Shibuya et al. | |
| 6,688,224 | B2 * | 2/2004 | Herda et al. | 101/227 |

FOREIGN PATENT DOCUMENTS

| | | |
|---|---|---|
| DE | 38 21 442 C2 | 9/1993 |
| DE | 196 25 084 A1 | 1/1998 |
| DE | 197 55 428 A1 | 6/1999 |

* cited by examiner

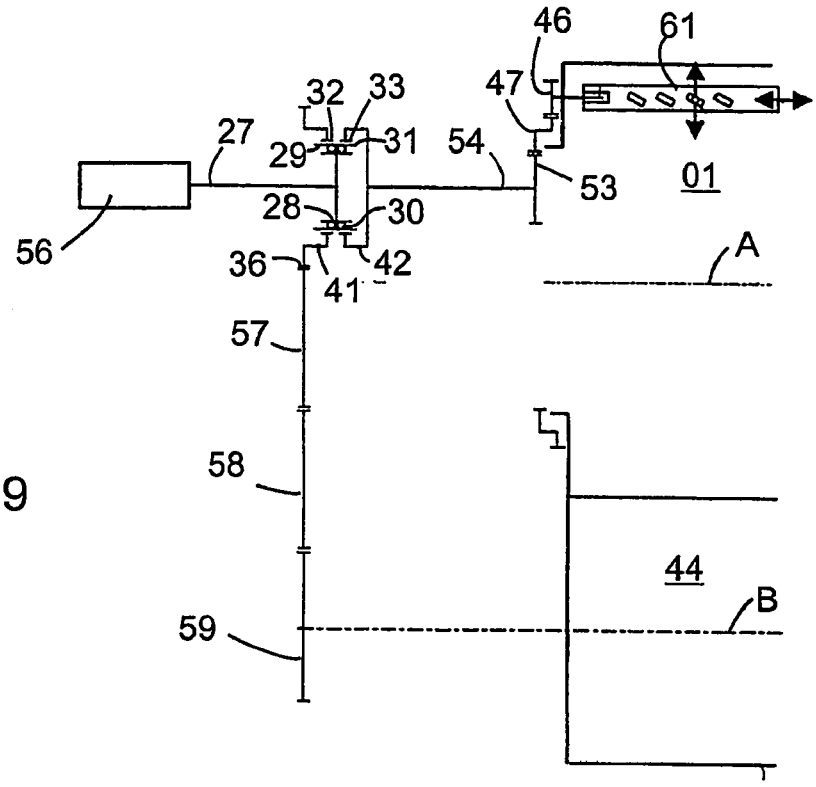
Fig. 9
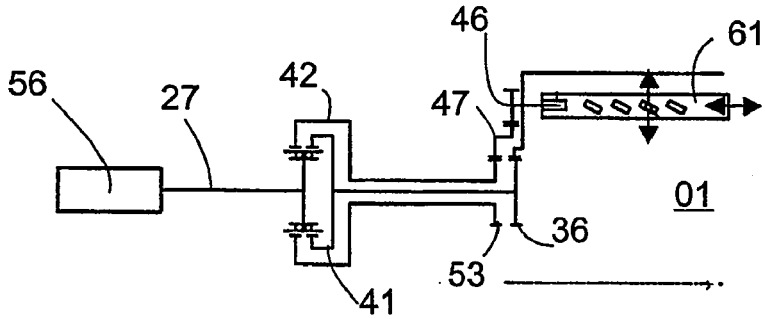
Fig. 10
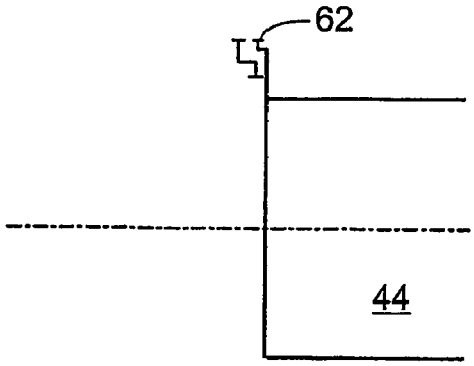

FOLDING GEAR COMPRISING A CYLINDER WITH ADJUSTABLE CIRCUMFERENCE

FIELD OF THE INVENTION

The present invention is directed to a folding apparatus having a cylinder whose circumference is adjustable. The cylinder is rotatably supported on the frame and has at least one hoop or ring supported on its shell surface.

BACKGROUND OF THE INVENTION

A prior folding apparatus is known from DE 38 21 442 C2, for example. A folding apparatus with a folding cylinder is described in this document as the prior art of this technology. A shell surface of the cylinder of this prior device is constructed of segments which are fixedly mounted on a frame of the cylinder, as well as of movable hoops, which bridge gaps between the segments. These hoops have two ends in the circumferential direction of the cylinder, one of which is fixedly mounted on one of the segments, while the other is adjustable with the aid of a strip which can be displaced parallel with the axis of the cylinder. A conversion of the axis-parallel adjustment movement of the strip, to a displacement of the end of the hoop, takes place with the aid of a pin, which pin is fixedly mounted on a sliding plate of the strip connected with the displaceable end of the hoop and which engages an elongated hole, that is oriented obliquely, in respect to the extension of the strip. By displacing the movable end of the hoop in the direction of the fixed end of the hoop, with the aid of this mechanism, arching of the hoop and therefore an increase of the circumference of the cylinder is achieved.

In connection with a folding apparatus described as the invention in DE 38 21 442 C2, the adjustment movement of the strip itself is driven with the aid of a planetary gear which, with the folding cylinder rotating, allows the rotation of two sun wheels which are coaxial with the folding cylinder. One of the sun wheels meshes with a plurality of intermediate wheels, which in turn mesh with pinion gears. The pinion gears are connected, fixed against relative rotation, with a helical spindle which engages a screw thread of the strip. The rotation of the spindles drives a translation of the strips.

With this construction, the hoops are compressed in the longitudinal direction if the circumference is to be increased. Since the hoops or bows must have a degree of stiffness, which is not negligible, in order not be deformed during contact with the material to be processed during the operation of the folding apparatus, a considerable force is required to accomplish this compression. In most cases, an adjustment movement requires a multitude of revolutions of the spindle.

DE 197 55 428 A1 describes a device for displacing two cylinder bodies of a folding cylinder by the use of a harmonic drive mechanism.

SUMMARY OF THE INVENTION

The object of the present invention is directed to providing a folding apparatus including a cylinder whose circumference can be adjusted.

In accordance with the present invention, this object is attained by providing the cylinder, which is rotatably supported in a frame, with at least one hoop on its shell surface. The at least one hoop can be displaced by the operation of an adjusting gear assembly. That adjusting gear assembly is in the form of a flexible toothed sleeve, which is deformed by an out of round section of a shaft, and at least one internally geared wheel which meshes with the sleeve. The result is a harmonic drive gear.

The advantages which can be obtained by the present invention consist, in particular, in that the employment of a "harmonic drive" mechanism permits a very compact structure, along with a large load-bearing capacity.

By connecting the out-of-round section of the shaft of the "harmonic drive" mechanism with the drive mechanism for driving the displacement of the hoops, it is possible to achieve very low gear ratios for the transmission of the revolution of the drive mechanism to the hoops, and therefore to obtain and to accomplish a very sensitive regulation with a small outlay of force at the drive mechanism.

The "harmonic drive" mechanism is preferably designed with two stages. The internally geared wheel of one stage is coupled to the rotation of the cylinder, and the one of the other stage provides coupling to the movement of the hoops by way of a gear wheel which is rotatable around the axis of the cylinder relative to the latter.

In accordance with a first preferred embodiment of the present invention, a gear wheel, by the use of which the internally geared wheel coupled to the rotation of the cylinder is driven, can be rigidly connected with the cylinder. In other words, a drive train for the internally geared wheel can extend via the cylinder, or a common drive train for the internally geared wheel and the cylinder extends via this gear wheel. Alternatively, there is the option of providing an independent drive train for this internally geared wheel which is parallel with the one for the cylinder. Both drive trains can, in particular, originate from a common second driven cylinder.

The tooth numbers of the first and second tooth arrangement at the internally geared wheels of the "harmonic drive" mechanism, of the drive wheels which are coaxial to the cylinder, and of the flexible sleeves, are preferably selected in such a way that, with a stopped drive mechanism, the gear wheels rotate at the same number of revolutions. However, in this case, the tooth numbers of the first and second tooth arrangements, of the drive wheels which are coaxial to the cylinder, and of the flexible sleeves, must not all be identical in pairs.

Preferably, the tooth numbers of the flexible sleeves are selected to be identical, but those of the internally geared wheels are selected to be different. If then, the tooth numbers of the second tooth arrangements are identical, the tooth numbers of the coaxial gear wheels and of the second tooth arrangements should be in the same ratio.

In accordance with a first preferred embodiment of the present invention, the other gear wheel, which is coupled to the hoops, has an external tooth arrangement. In accordance with a further preferred development, however, this other gear wheel is embodied as a crown gear. This makes possible the placement of the "harmonic drive" gear near the shaft of the cylinder, and therefore results in a particularly compact construction of the folding apparatus.

One option of driving the displacement of the hoops is the use of an eccentric that is driven by the other gear wheel. A second option is the use of a displaceable strip with cam faces, which cam faces are engaged by the respective loops of the cylinder.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
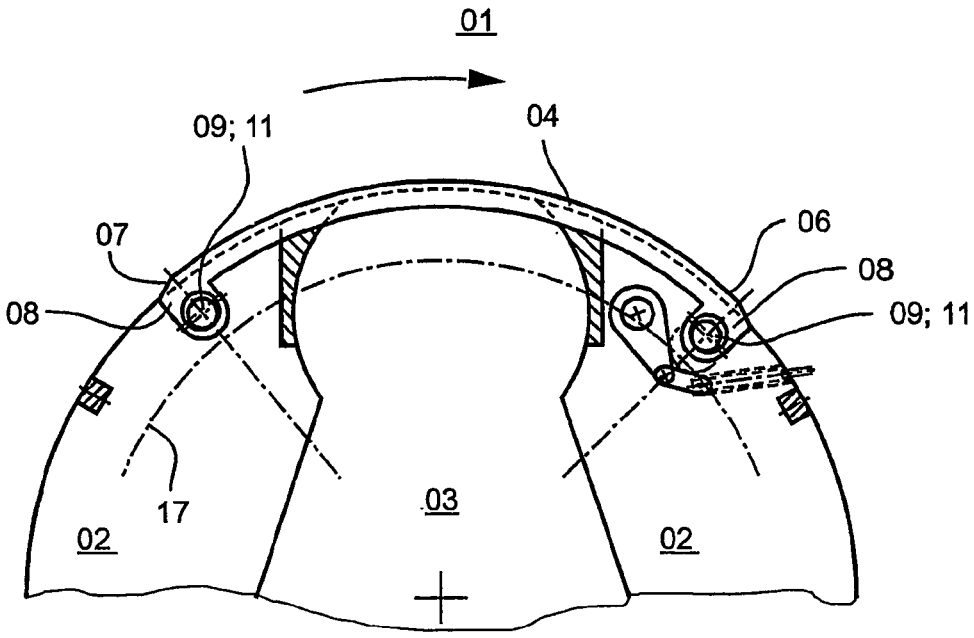
FIG. 1, a partial section through a cylinder in accordance with a first preferred embodiment of the present invention and taken transversely to its longitudinal axis, in FIG. 2, a partial section through the cylinder and taken parallel to the longitudinal axis of the cylinder, and showing the eccentric shaft, in FIG. 3, a simplified partial section, analogous to that shown in FIG. 1 through the cylinder, and taken in a first phase of the adjustment movement of the eccentric shaft, in FIG. 4, a partial section analogous to that in FIG. 3 taken in a second phase of the adjustment movement, in FIG. 5, a partial section through a first modification of the cylinder of the first preferred embodiment shown in FIG. 1, in FIG. 6, a partial section through a second modification of the cylinder of the first preferred embodiment shown in FIG. 1, in FIG. 7, a cross-section through an adjustment gear for rotating the eccentric shafts, in FIG. 8, a perspective plan view of a folding cylinder and of a blade cylinder of a folding apparatus in accordance with a second preferred embodiment of the present invention, in FIG. 9, a schematic representation of the gear of the folding apparatus in FIG. 8, in FIG. 10, a first modification of the gear shown in FIG. 9, in FIG. 11, a second modification of the gear shown in FIG. 9, in FIG. 12, a third preferred embodiment of the present invention, in the form of a cross-section through the head area of a folding cylinder, in FIG. 13, a section through the folding cylinder in FIG. 12 at the level of the toothed belt, and in FIG. 14, a modification of the embodiment in FIG. 12.

A schematic partial cross-sectional view through a cylinder 01, for example a folding cylinder 01, and in particular through a folding blade cylinder, in a plane perpendicularly to its longitudinal axis, is shown in FIG. 1. A shell surface of the folding cylinder 01 is substantially composed of three segments 02, two of which segments 02 are represented in FIG. 1, and all three of which segments 02 are mounted fixedly on a frame of the folding cylinder 01 with cover disks, which are not specifically represented. The segments 02 are separated from each other by a cylinder gap 03. The number of the segments 02 and of the gaps 03 of the folding cylinder 01 can, of course, also be other than three.

A folding blade is pivotably housed in each cylinder gap 03. Since the folding blade in each cylinder gap 03 is not a part of the present invention, it is not represented in FIG. 1 and will not be further described here.

Figure 2:
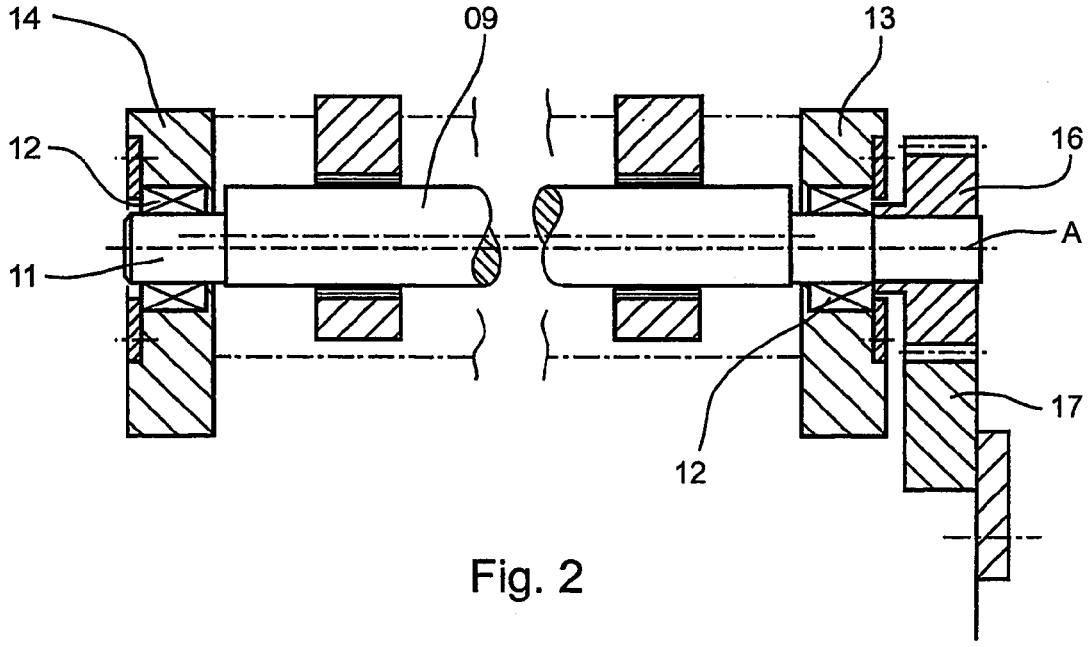

Each of the cylinder gaps 03 is bridged by a plurality of hoops 04 or hoop-like bands which are longitudinally extending in a circumferential direction of the folding cylinder 01. In the axial direction the of the folding cylinder 01, hoops 04 are separated from each other by spaces, through which spaces respective teeth of the folding blade can be extended out of the cylinder gap 03. Each of two spaced linear ends 06, 07 of each of the hoops 04 have an eye 08, which eye 08 protrudes, or extends into an interior region of the folding cylinder 01 and each which eye 08 has a circular bore, in which an eccentric 09 is rotatably seated. As shown in FIG. 2, the eccentric 09 is embodied as one part of a shaft 11. On each of its ends, the shaft 11 is supported by a bearing 12, for example by a roller bearing 12, in a cover disk 13, 14, which cover disk 13, 14 is a part of the frame of the folding cylinder 01. A first gear wheel 16 is mounted at an end of the shaft 11, which shaft end 11 extends past the adjacent cover disk 13.

In the first preferred embodiment of the present invention, as shown in FIG. 1, a shaft 11 is arranged on each of the two sides of each gap 03. Since the folding cylinder 01 has a total of three gaps 03, there is a total of six shafts 11. The first gear wheels 16 of all of these six shafts 11 all mesh in the same way with a second gear wheel 17, depicted here in the form of a crown gear 17 and provided with an external tooth arrangement, which crown gear 17 is arranged, concentrically rotatable around an axis of rotation A of the folding cylinder 01, on the cover disk 13, and whose pitch circle is indicated in the form of a dash-dotted line in FIG. 1. Thus, by the effecting of a rotation of the second gear wheels 17, all eccentrics 09 are rotated to the same extent, and the hoops 04 are moved. The way the second gear wheel 17 is rotationally driven will be discussed in more detail subsequently.

Figure 3:
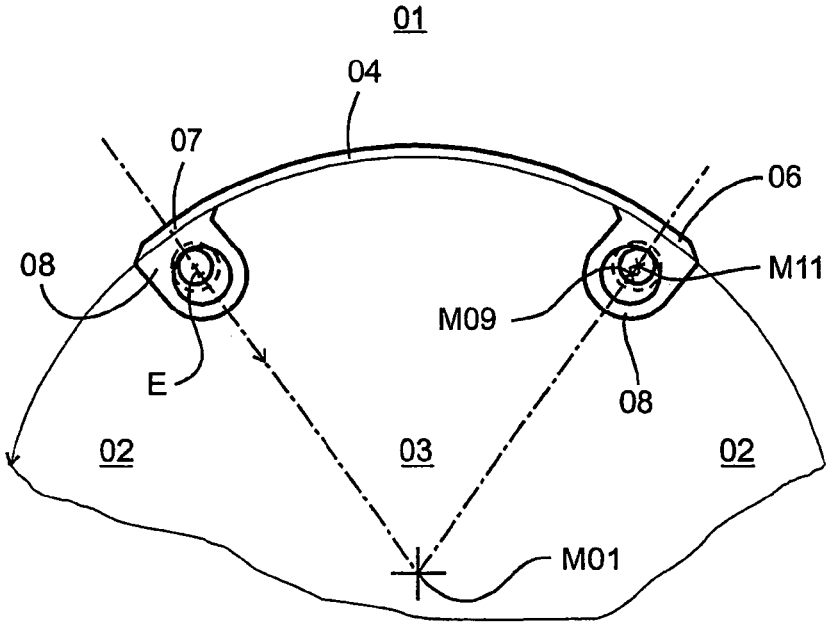
Figure 4:
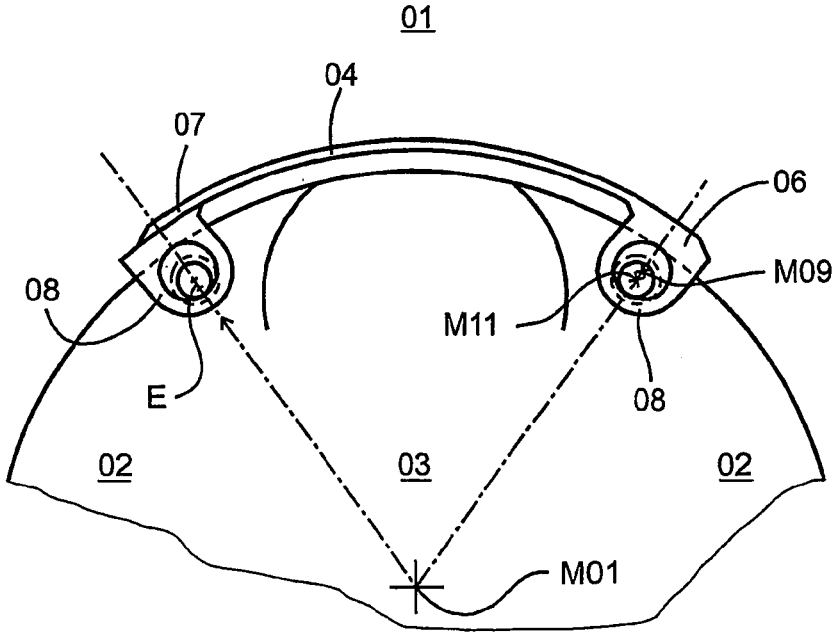

FIGS. 3 and 4 show two distinct phases of the movement of the hoops 04 which are caused by the rotation of the gear wheels 17, 16. FIG. 3 corresponds, in a simplified form, to the plan view of FIG. 1. With respect to the centers M11 of the shafts 11, in FIG. 3 the centers M09 of the eccentrics 09 are each offset radially in the direction toward the center M01 of the folding cylinder 01, i.e. an eccentricity vector E, extending respectively from the center M11 of the shaft 11 to the center M09 of the eccentric 09, is oriented radially inward. The hoop 04 rests against the surfaces of the segments 02 at the spaced sides of the cylinder gap 03.

The eccentricity vectors E of each of the two shafts 11 for each hoop 04 intersect at an angle corresponding to the angular distance of the shafts 11 in relation to the center M01 of the folding cylinder 01. This does not change, even with a rotation of the second gear wheel 17 with respect to the folding cylinder 01.

In FIG. 4, the shafts 11 are each rotated by 180° from their positions in FIG. 3, and the centers M09 of the eccentrics 09 are now displaced radially outward with respect to the centers M11 of the shafts 11, i.e. the eccentricity vector E is now directed radially oriented toward the outside. The hoop 04 is now spaced at a distance from the surface of the segments 02 corresponding to twice the eccentricity of each eccentric 09 with respect to its position shown in FIG. 3.

During the transition of the hoops 04 from the inner position shown in FIG. 3 to the outer position shown in FIG. 4, the two eyes 08 of the hoop 04 not only move away from the center M01 of the folding cylinder 01. They also move apart from each other. To make such a movement possible, the hoop 04 can be extended in the circumferential direction with the aid of a rail mechanism which is not specifically shown. For example, one of the hoop's eyes 08, the one on the left in FIG. 4, is connected, displaceable in the circumferential direction, with the associated linear end 07 of the hoop 04 by the use of a guide rail.

Figure 5:
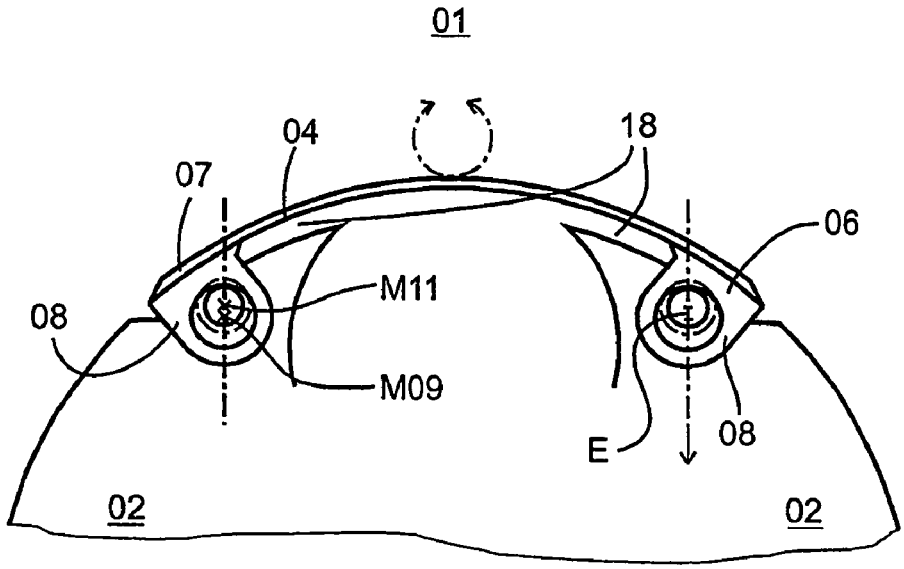

FIG. 5 shows a modified preferred embodiment of the folding cylinder 01. In this second embodiment, the eccentricity vectors E of the two eccentrics 09 are always exactly parallel. This means that in the position of the eccentrics 09 represented in FIG. 5, their centers M09 are displaced in the vertical direction of FIG. 5 in respect to the centers M11 of the shafts 11. The parallel orientation of the eccentricities is maintained, even if the shafts 11 are rotated with the aid of the second gear wheel 17, which is not specifically represented in FIG. 5. During a complete revolution of each of the shafts 11, each point on the hoop 04 travels in a circular track of a radius corresponding to the amount of eccentricity of the eccentrics 09. No deformation of the hoop 04 occurs. The connection of the hoop 04 with the eyes 08 can also be rigid in this embodiment, since, in the course of a revolution of shafts 11, the distance between the two eyes 08 does not change. With this embodiment, it is not possible that, in a "retracted" position of hoop 04, corresponding to a minimal circumference of the folding cylinder 01 analogous to the position depicted in FIG. 3, the hoop 04 simultaneously touches both segments 02, which are partially covered by it. Instead, in the "retracted" position represented in FIG. 5, and corresponding to a minimal circumference of the folding cylinder 01, the hoop 04 is separated from both adjacent segments 02 by a respective gap 18.

Figure 6:
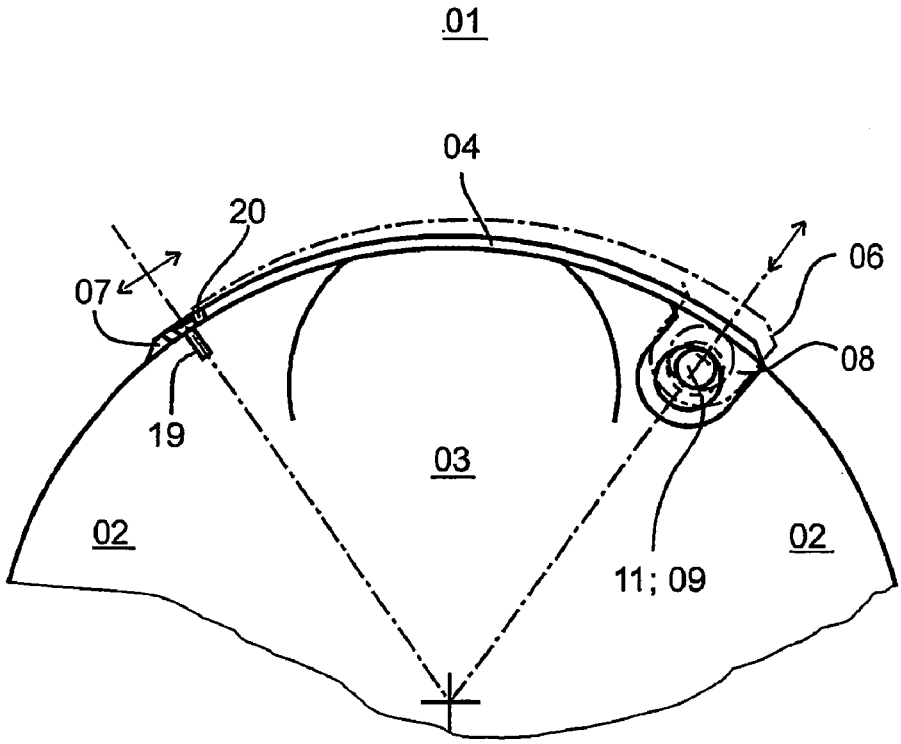

A third, preferred embodiment of the folding cylinder 01 of the present invention is represented, in a simplified manner, in FIG. 6. Here, an eye 08 has been arranged on only one linear end 06 of the hoop 04. The other linear end 07 of hoop 04 is fastened on a cylinder segment 02, for example with the aid of a screw 19 which passes through an elongated hole 20 situated at the linear end of the hoop 04 not provided with eye 08. If, with this embodiment, the shaft 11 is rotated, the linear end 06, with the eye 08, is lifted and lowered in the radial direction. At the same time, the linear end 07 without the eye 08, is displaced in the circumferential direction of cylinder 01 in relation to the screw 19. A deformation of the hoop 04 is practically not required for such a displacement of hoop 04. Therefore the displacement of hoop 04 requires only a small outlay of force.

Such a construction of the end 07 of hoop 04, without the eye 08, can also constitute the rail mechanism mentioned above in relation to FIG. 4.

There is also a possibility of fastening the linear end 07 immovably on the segment 02. In this case, a rotation of the shaft 11 and a change of the circumference of the folding cylinder is also possible, but it is necessary, in order to accomplish this, that the hoop 04 have a greater elasticity than in the previously discussed preferred embodiments, since the change is connected with a compression of the hoop 04.

Changing the circumference of the cylinder 01 means that an at least partial change of the radius of cylinder 01 also takes place.

Figure 7:
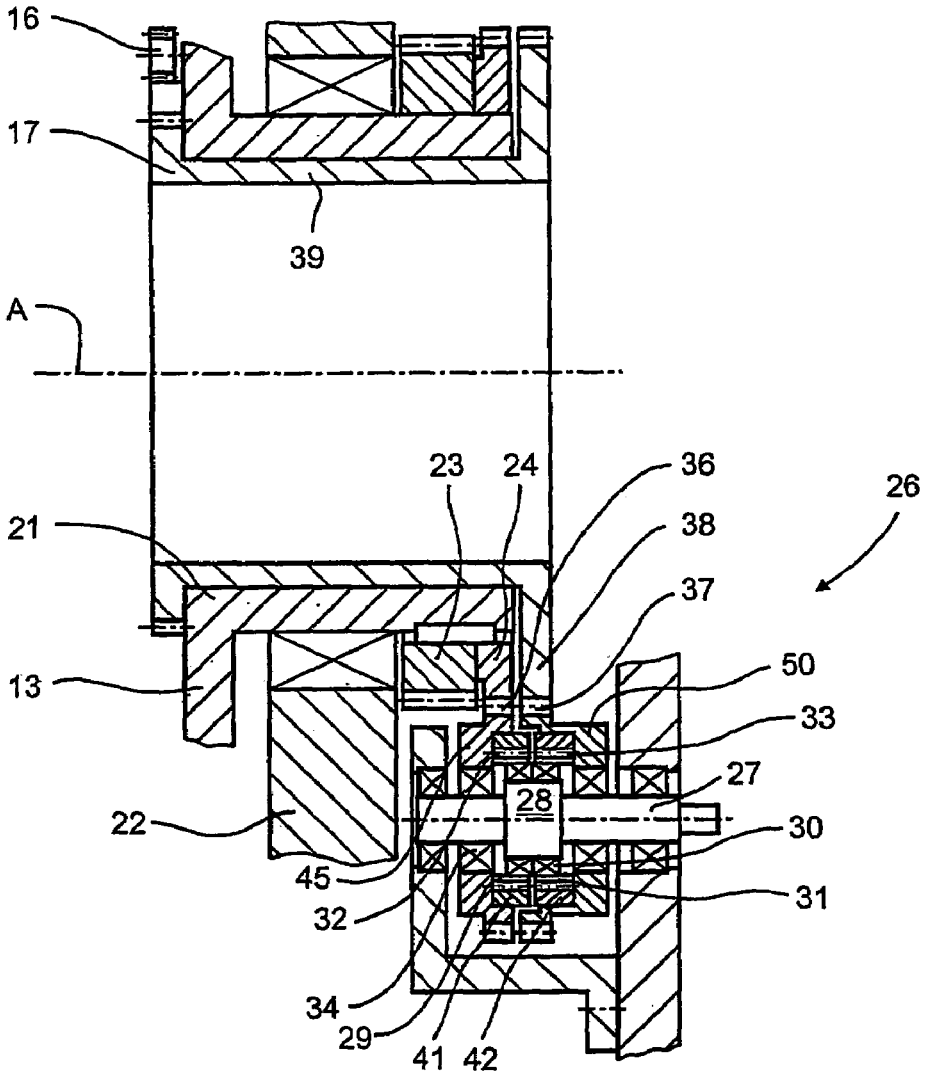

FIG. 7 shows a mechanism which, in use with a rotating folding cylinder 01, permits a turning of the second gear wheel, or crown gear, 17, shown in FIG. 2, relative to the folding cylinder 01, and therefore accomplishes a change of the circumference of folding cylinder 01. FIG. 7 is a partial section through a frame of a folding apparatus in a plane which is parallel to the longitudinal axis of the folding cylinder 01. A hollow shaft 21 formed on one of the cover disks 13 is rotatably seated in a lateral plate 22 of the frame. A drive gear wheel 23, which transfers the torque of a non-represented motor to the folding cylinder 01, is wedged on an end of the hollow shaft 21 facing away from the cover disk 13.

An adjusting gear assembly 26, for example a "harmonic drive" gear 26, is fixedly mounted on the frame of the folding apparatus. It comprises a shaft 27, for example an adjusting shaft 27, which is connected with a drive mechanism, which is not specifically represented in FIG. 7, for example a motor or an arrestable crank. The adjusting shaft 27 has an out-of-round section 28, or more exactly an elliptical cross section, also called rotor 28, on which, separated by bearings 30, for example ball bearings 30 of elliptical cross section corresponding to the shape of the rotor 28, two flexible sleeves 29, 31 have been pushed, each of which has exterior tooth arrangements. The two sleeves 29, 31 are connected with each other, fixed against relative rotation, and mesh with respective tooth arrangements 32 or 33, for example interior tooth arrangements 32 or 33, of a internally geared wheel 41 or 42 of circular cross section surrounding them. The internally geared wheels 41, 42 are connected with further gear wheels 45, 50. These gear wheels 45, 50 are seated, rotatable around the adjusting shaft 27, with the aid of bearings 34, for example ball bearings 34. Each of these further gear wheels 45, 50 has a tooth arrangement 36, 37, for example an exterior tooth arrangement 36, 37, of which the one exterior tooth arrangement 36 meshes with a gear wheel 24, which is arranged next to the drive gear wheel 23 and is wedged, the same as the latter, on the hollow shaft 21. The other exterior tooth arrangement 37 meshes with a gear wheel 38, which is rotatable around the axis A of the folding cylinder 01 and is connected with a rigid sleeve 39 extending through the interior of the hollow shaft 21 into the interior of the folding cylinder 01 and there supports the already mentioned second gear wheel 17, which drives the displacement movement of the hoops 04 via the first gear wheels 16.

If the folding cylinder 01 is driven at a circumferential speed n01, this results in the internally geared wheel 41 of the "harmonic drive" gear 26 also rotating at a speed of $$n41 = n01\frac{z24}{z36}$$

wherein the respective tooth numbers z24, z36 are those of the gear wheel 24 or of the external tooth arrangement 36. If the adjusting shaft 27 is at rest, this results in a rotation of the sleeves 29, 31 at a rotational speed of $$n29 = n41\frac{z29}{z32}$$

wherein the respective tooth numbers z29, z32 are those of the sleeve 29 or the interior tooth arrangement 32 of the internally geared wheel 41. From this results a number of revolutions $$n42 = n29\frac{z31}{z33}$$

of the internally geared wheel 42 in turn, wherein the respective tooth numbers z31, z33 are those of the sleeve 31 or of the interior tooth arrangement 33 of the internally geared wheel 42. From this results a number of revolutions $$n38 = n41\frac{z37}{z38}$$

of the gear wheel 38, wherein the respective tooth numbers z37, z38 are those of the exterior tooth arrangement 37 or of the gear wheel 38.

So that, with the adjusting shaft 27 stopped, the second gear wheel 17 will rotate at exactly the speed of the folding cylinder 01, it is necessary that the requirement $$\frac{z37\,z31\,z32\,z24}{z38\,z33\,z29\,z36} = 1 \quad (1)$$

be met.

In order to cause a rotation of the second gear wheel 17, in relation to the folding cylinder 01, by the rotation of the adjusting shaft 27, it is furthermore necessary that either the tooth numbers z29, z31, z32, z33 of the two sleeves 29, 31, or of the crown gears 32, 33, or both, differ. If this were not the case, a rotation of the adjusting shaft 27 would not result in a rotation of the internally geared wheels 41, 42 in relation to each other.

This means that the mechanism in FIG. 7 must fulfill the conditions of equation 1 and, at the same time $$z29 \neq z31 \vee z32 \neq z33 \quad (2)$$

must apply.

The two conditions can be met in general, because the gear wheels 24, 38 have a considerably greater diameter than the internally geared wheels 41, 42 and can have a large number of teeth z24, z38, which are only slightly different from each other.

Thus, it is possible, for example, to select the tooth numbers of the interior and of the exterior tooth arrangements of the internally geared wheels 41, 42 to be identical in pairs, and to accept a slight difference between the tooth numbers z29, z31 of the flexible sleeves 29, 31. In this case the equation 1 is reduced to $$\frac{z31\ z24}{z38\ z29} = 1 \quad (3)$$

i.e. the synchronous running of the gear wheel 17 with the folding cylinder 01, while the adjusting shaft 27 is stopped, is assured if the tooth numbers z29, z31 of the flexible sleeves 29, 31 are at the same ratio to each other as those of the gear wheels 24, 38:

$$\frac{z29}{z31} = \frac{z38}{z24}$$

It is therefore sufficient to select the tooth numbers z24, z38 of the gear wheels 24, 38 and of the flexible sleeves 29, 31 to be identical in pairs.

The smaller the difference of the tooth numbers z9, z31 of the flexible sleeves 29, 31, the more sensitively can the turning of the gear wheels 24, 38 toward each other be performed by rotating the adjusting shaft 27. Approximately n31/(n31−n29) revolutions of the adjusting shaft 27 are required for rotating the gear wheels 24, 38 by 360° in relation to each other.

Alternatively, it is possible, for example, to select the tooth numbers z29, z31, z36, z37 of the flexible sleeves 29, 31 and of the exterior tooth arrangements 36, 37, respectively identical in pairs, and to accept a slight difference between the tooth numbers z32, z33 of the interior tooth arrangements 32, 33. In this case, Equation 1 is reduced to $$\frac{z32}{z38}\frac{z24}{z33} = 1 \quad (4)$$

i.e. the synchronous running of the gear wheel 17 with the folding cylinder 01, while the adjusting shaft 27 is stopped, is assured, if the tooth numbers z29, z31 of the flexible sleeves 29, 31 are at the same ratio to each other as are those of the gear wheels 24, 38:

$$\frac{z32}{z33} = \frac{z38}{z24}$$

It is therefore sufficient to select the tooth numbers z24, z38, z32, z33 of the gear wheels 24, 38 and of the interior tooth arrangements 32, 33 to be identical, in pairs, in order to assure, with the adjusting shaft 27 at a stop, the synchronous running of the gear wheel 38 with the folding cylinder 01 and, in this way, to prevent the unintentional displacement of the hoops 04.

Figure 8:
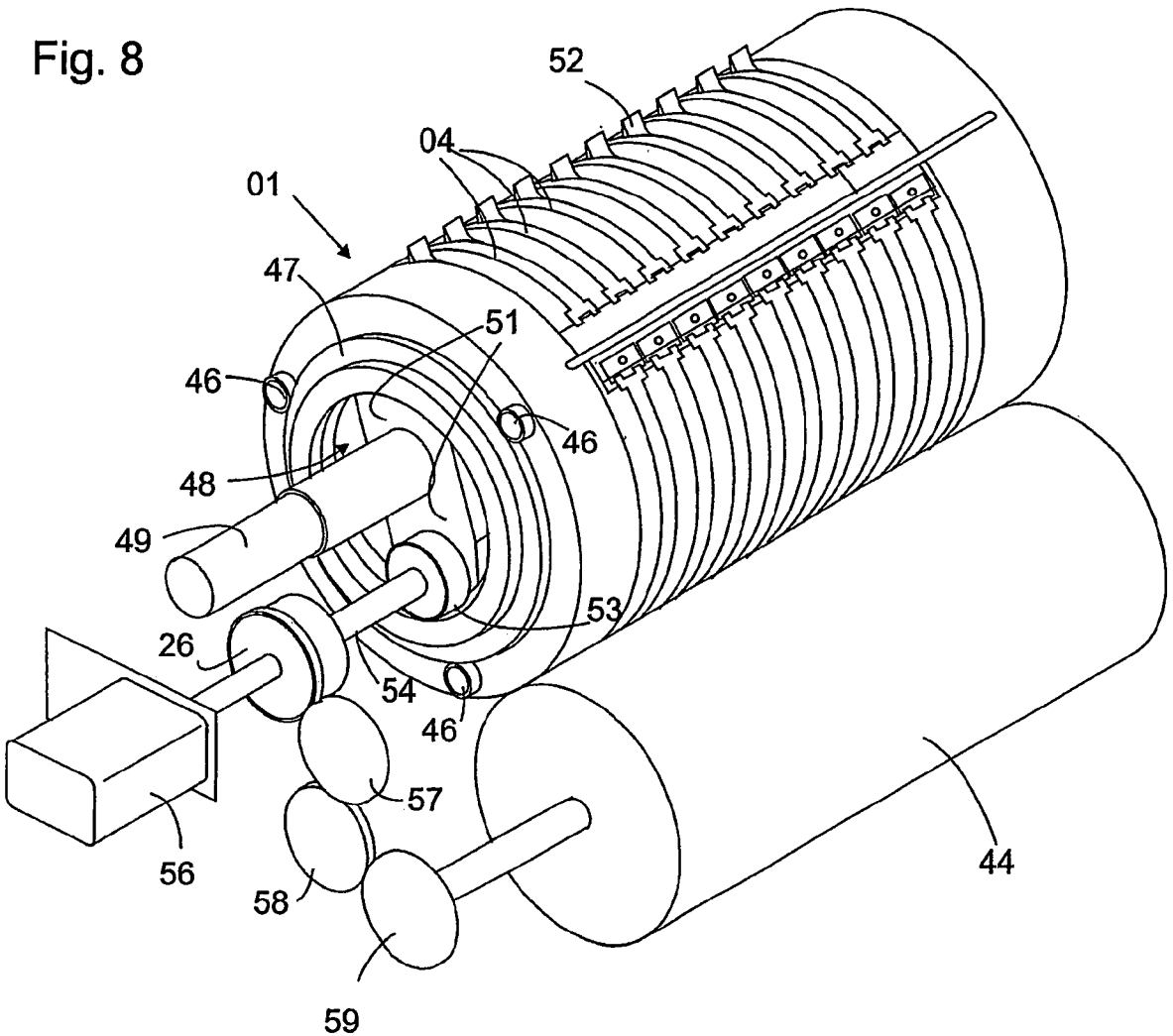

FIG. 8 shows a perspective view of a folding cylinder 01 and of a cooperating cylinder 44, for example a blade cylinder 44 of a folding apparatus, in accordance with a second preferred embodiment of the present invention. The blade cylinder 44 is directly connected with a drive motor, which is not specifically represented. A drive train of the folding cylinder 01 extends from the motor via the blade cylinder 44 and a gear, also not specifically represented, and which is arranged between the cylinders 01, 44.

The blade cylinder 44 supports two blades, each extending over its entire axial width, for use in cutting an endless strand of material into individual products to be folded. These blades, as well as suitable grippers or pointed needles of the folding cylinder 01, which are used for holding the separated product, are not represented in FIG. 8, since they are generally known. Flexible hoops 04 on the surface of the cylinder 01 are maintained fixed on one of their ends and are displaceable in the circumferential direction of the folding cylinder 01 on the other one, as generally disclosed in the publication DE 38 21 442 C2, which was cited at the outset of the specification. Pins, which, starting at their displaceable ends, are oriented into the interior of the folding cylinder 01, each engage oblique, axially displaceable slits of a strip 61 that is hidden in the interior of the cylinder 01 and which is shown schematically in FIG. 9. In this way, the lateral flanks of the slits constitute cam surfaces, by the use of which the strips 61 drive a deformation of the hoops 04. In the second preferred embodiment represented in FIGS. 8 and 9 , three groups of hoops 04 are provided, which three groups follow each other in the circumferential direction of the folding cylinder 01. Three strips 61 are correspondingly provided. Each one of these strips 61 has an internal screw threaded bore on its end face, which internal screw threaded bore is engaged by a threaded shaft. Each threaded shaft, which is maintained rotatably, but axially fixed in the cylinder 01, has a pinion 46 on one end, which pinion 46 is visible at the end face of the folding cylinder 01. All three pinions 46 mesh with an exterior tooth arrangement of a crown gear 47, which is rotatably arranged on the end of the folding cylinder 01 and which encircles a central opening 48, as seen more clearly in FIG. 8. A shaft 49 of a folding blade support or spider extends eccentrically through the opening 48 into the interior of the folding cylinder 01. The spider supports folding blade shafts on diametrically oppositely located arms 51, which are essentially hidden in FIG. 8, and on each of which, a comb-like folding blade 52 is mounted. The folding blade 52 rotates around its respective folding blade shaft, coupled to the rotation of the spider around the shaft 49. Tips of the comb-like folding blade 52, and, extending out of slits between the gaps 04, are represented in FIG. 8.

A gear wheel 53 is furthermore arranged in the opening 48 and meshes with an interior tooth arrangement of the crown gear 47. The gear wheel 53 is rigidly coupled via a shaft 54 with a "harmonic drive" or adjusting gear 26. The internal structure of the adjusting gear 26, and its relationship with an adjusting drive mechanism 56 and with the blade cylinder 44 can be best seen in FIG. 9, which represents the structure shown in FIG. 8 in the form of a schematic sectional view. The structure of the "harmonic drive" gear 26 is the same as that described with respect to FIG. 7 and will not be explained again. In FIG. 7 and in FIG. 9 the same reference symbols have been used for identical components of the "harmonic drive" gear 26. The gear wheel 53, although separated from the internally geared wheel 42 by the shaft 54, can be considered to be equivalent with the exterior tooth arrangement 37 represented in FIG. 7.

The exterior tooth arrangement 36 of the internally geared wheel 41 meshes with a gear wheel 57, for example a first intermediate gear wheel 57, which is coupled via a further gear wheel 58, for example a second intermediate gear wheel 58, with a gear wheel 59, which is rigidly fixed on the blade cylinder 44. Thus, a drive train for the crown gear 47 extends from the blade cylinder 44 via the gear wheels 59, 58, 57 to the "harmonic drive" gear 26, and via the shaft 54 on to the gear wheel 53. The ratio of the numbers of revolutions of the blade cylinder 44 and of the folding cylinder 01 corresponds to the ratio of the groups of parallel hoops 04 on the folding cylinder 01 to the number of blades of the blade cylinder 44, and in the case here considered is 3:2. The tooth numbers on the drive train of the crown gear 47, such drive train consisting of the components 59, 58, 57, 26, 53, has been fixed in such a way that the crown gear 47 rotates at the same speed as the cylinder 01 as long as the adjusting shaft is stopped. The strip 61 is not axially displaced, and the shape of the hoops 04 thus remains unchanged. Turning the adjusting shaft 27 causes turning of the crown gear 47 with respect to the folding cylinder 01, and in this way axial movement of strip 61 is used for deforming the hoops 04, which deformation of the hoops 04 changes the circumference of the folding cylinder 01.

The schematic sectional view represented in FIG. 10 differs from that in FIG. 9 in that the exterior tooth arrangement 36 of the internally geared wheel 41 is not coupled to the blade cylinder 44 but, as in the preferred embodiment in FIG. 7, meshes directly with a gear wheel 62, which is rigidly connected with the folding cylinder 01. In contrast to the gear wheel 38 in FIG. 7, the gear wheel 62 is an internally geared wheel 62. The tooth number formulas cited in connection with FIG. 7 can be analogously applied in order to determine tooth numbers which assure a synchronous running of the crown gear 47 with the folding cylinder 01 also for this gear.

Figure 11:
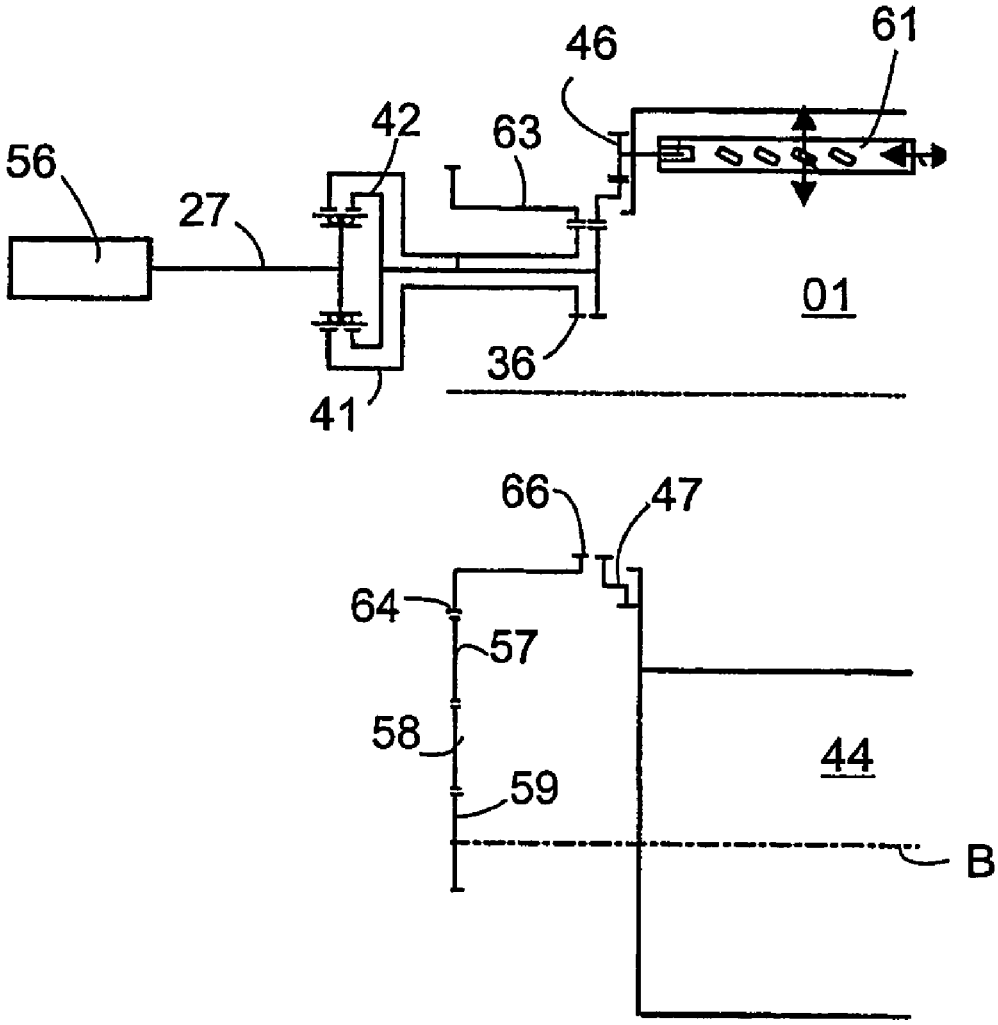

As previously mentioned above, the folding cylinder 01 has holding devices, such as grippers or pointed needles which, in coordination with the rotation of the cylinder 01, are movable in order to close over or engage a product conveyed to a fixed receiving point of the cylinder circumference and to hold the product for further conveyance and processing at the cylinder 01, and to open again at a delivery point, so that the product can be passed over to a further cylinder or the like. The holding devices can be operated in a single or in a collection mode of operation. In the single mode of operation the holding devices open during each passage through the delivery point in order to release the product they are holding. In the collection mode of operation, such a holding device passes the delivery point once without opening, then receives a second product in the course of a second passage through the receiving point and then releases both products together in the course of a second passage through the delivery point. The movement of these holding devices is controlled in a generally known manner with the aid of a cam disk, which is not specifically depicted, and which is coaxial to the folding cylinder 01 and on which the pivot arms of the holding devices roll off. The cam disk has a recess at a location corresponding to the delivery point and into which a passing pivot arm dips, whereupon the corresponding holding device opens and releases the product held. In order to accomplish the holding device only opening during every second passage through the delivery point, during collecting operations, a so-called cover disk is employed. This cover disk is parallel with the cam disk and rotates coaxially with the cylinder 01, but only at half the number of revolutions of the latter. The cover disk has a section of a large radius, which, in the course of every second passage through the delivery point, covers the recess on the cam disk and prevents the opening of the holding device. The cover disk also has a section of a lesser radius which, when it lies in front of the recess on the cam disk, permits the opening of the holding device. In the embodiment of the present invention represented in FIG. 11, such a cover disk, identified by 63, has been integrated into the drive train of the crown gear 47. As depicted in the diagram of FIG. 9, this drive train runs from the directly driven blade cylinder 44, via the gear wheel 59, which is rigidly coupled to the blade cylinder 44 and is aligned with the axis B of the latter, and two intermediate wheels 58, 57. The intermediate wheel 57 does not directly mesh with the exterior tooth arrangement 36 of the internally geared wheel 41, but instead meshes with an exterior tooth arrangement 64 of the cover disk 63, wherein the latter again has an interior tooth arrangement 66, which meshes with the exterior tooth arrangement 36. The tooth numbers of the gear elements 57, 58, 59, 64 have been selected to be such that half of the number of revolutions of the folding cylinder 01 results for the cover disk 63, i.e. with a ratio of the number of revolutions n01 of the folding cylinder 01 to the number of revolutions n44 of the blade cylinder 44 of n01/n44=2/3, the following must apply to the number of revolutions n63 of the cover disk 63: n63=n44/3. If the number of revolutions of the internally geared wheels 41, 42 of the "harmonic drive" gear 26 are identical when the adjusting shaft 27 is stopped, the result for the tooth numbers n66, n36, n53 and n47 of the interior tooth arrangement 66 of the cover disk 63, the exterior tooth arrangement 36 of the internally geared wheel 41, of the gear wheel 53 and the interior tooth arrangement of the crown gear 47 is the requirement $$\frac{z53}{z47} \cdot \frac{z66}{z36} = 3$$

Figure 12:
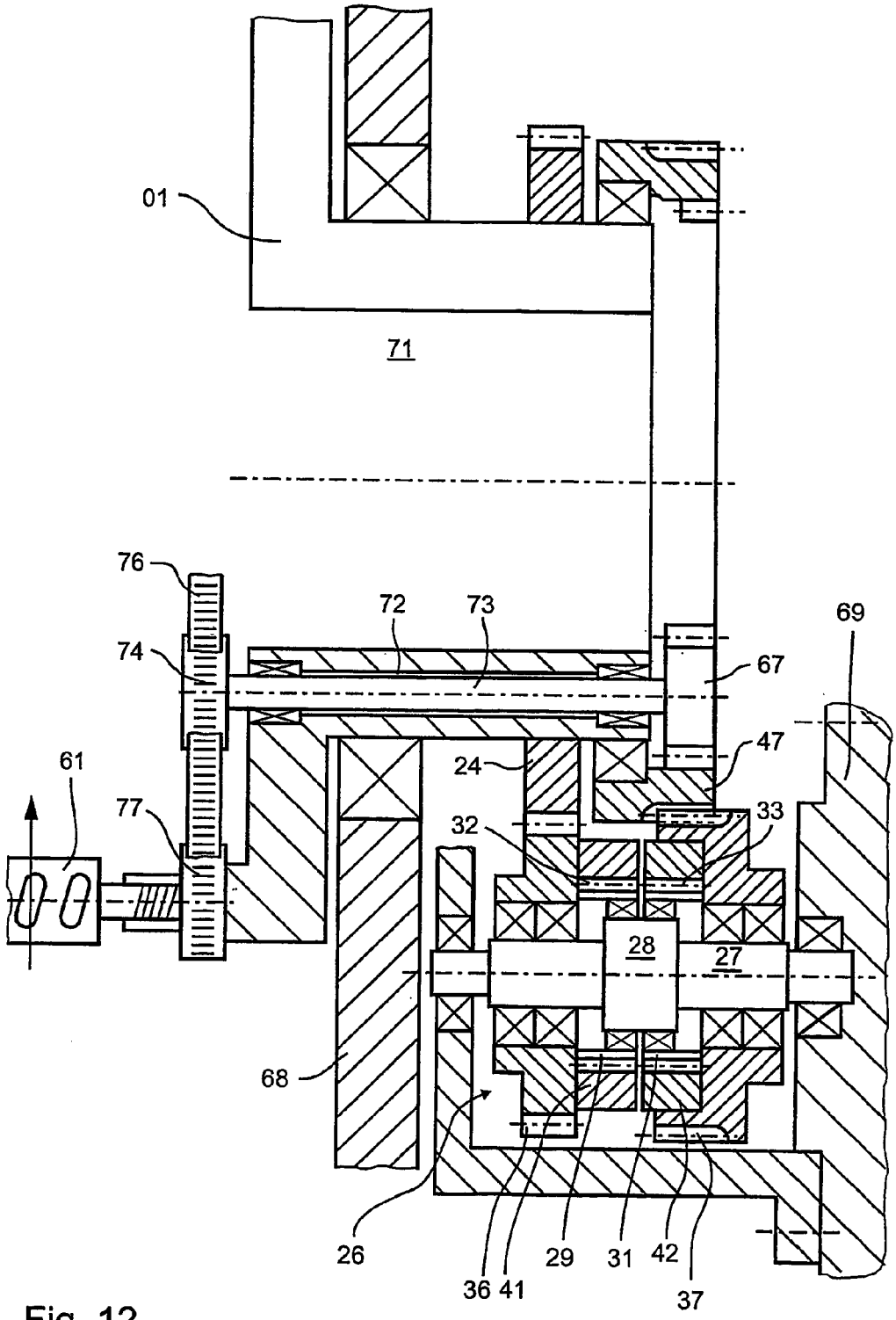

FIG. 12 shows a third preferred embodiment of the present invention, in the form of a cross-section through the head area of the folding cylinder 01 and of the adjoining portions of the lateral frame of a folding apparatus. Portions of two plates 68, 69 of the lateral frame can be seen, one of which, 68, supports a tapered shaft section 71 protruding from a front end of the folding cylinder 01. The plate 69 supports a "harmonic drive" gear assembly 26, whose structure, comprising the components 29, 31, 32, 33, 36, 37, 41 and 42, has been described previously in connection with FIG. 7 and will thus not be again explained here. The exterior tooth arrangement 36 meshes with a gear wheel 24 that is rigidly fastened on the shaft section 71. The exterior tooth arrangement 37 meshes with the exterior tooth arrangement of a crown gear 47 mounted rotatably around the end of the shaft section 71. The shaft 27 is connected with an adjustment drive mechanism, which is not specifically represented.

A bore 72 extends in the longitudinal direction of the tapered shaft section 71. A shaft 73 is rotatably maintained in the bore 72 and supports a pinion 67 on one end thereof, which pinion 67 is meshing with an interior tooth arrangement of the crown gear 47. On its other end shaft 73 carries a pulley 74. A toothed belt 76 is looped around the pulley 74 and around a plurality of pulleys 77. These pulleys 77 are used, in the same way as the pinions 46 in FIG. 8, for displacing the strips 61 which the hoops 04 engage in a displaceable manner and which displacement of the hoops 04 cause the circumferential change of the folding cylinder 01.

Figure 13:
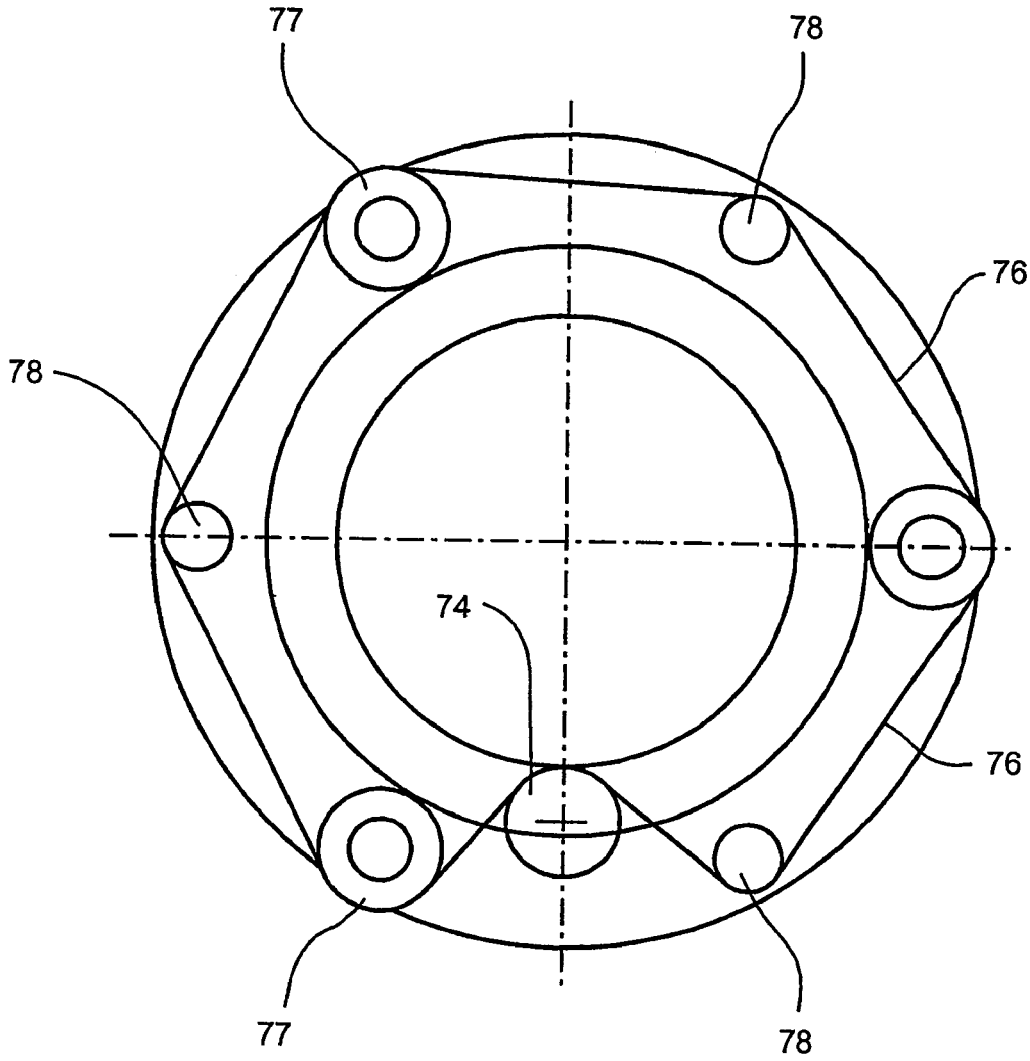

FIG. 13 shows schematically a section through the folding cylinder 01 at the level of the pulleys 74, 77 and the toothed belt 76. Between two pulleys 77, the toothed belt 76 loops around respective rollers 78, at least one of which is displaceable in the radial direction for tightening the toothed belt 76.

As long as the adjustment drive of the shaft 27 remains stopped, a rotation of the gear wheel 24 is transmitted to the crown gear 47 via the "harmonic drive" gear 26 at the same rotational speed. The shaft 73 does not rotate in its bore 72, and the strips 71 are not axially displaced. When the adjustment drive is actuated and the shaft 27 rotates, this leads to a displacement of the crown gear 47 with respect to the gear wheel 24. The result is a displacement of the strips 61 and a change of the circumference of the cylinder 01.

Link chains can also be employed in place of the toothed belt 76.

Figure 14:
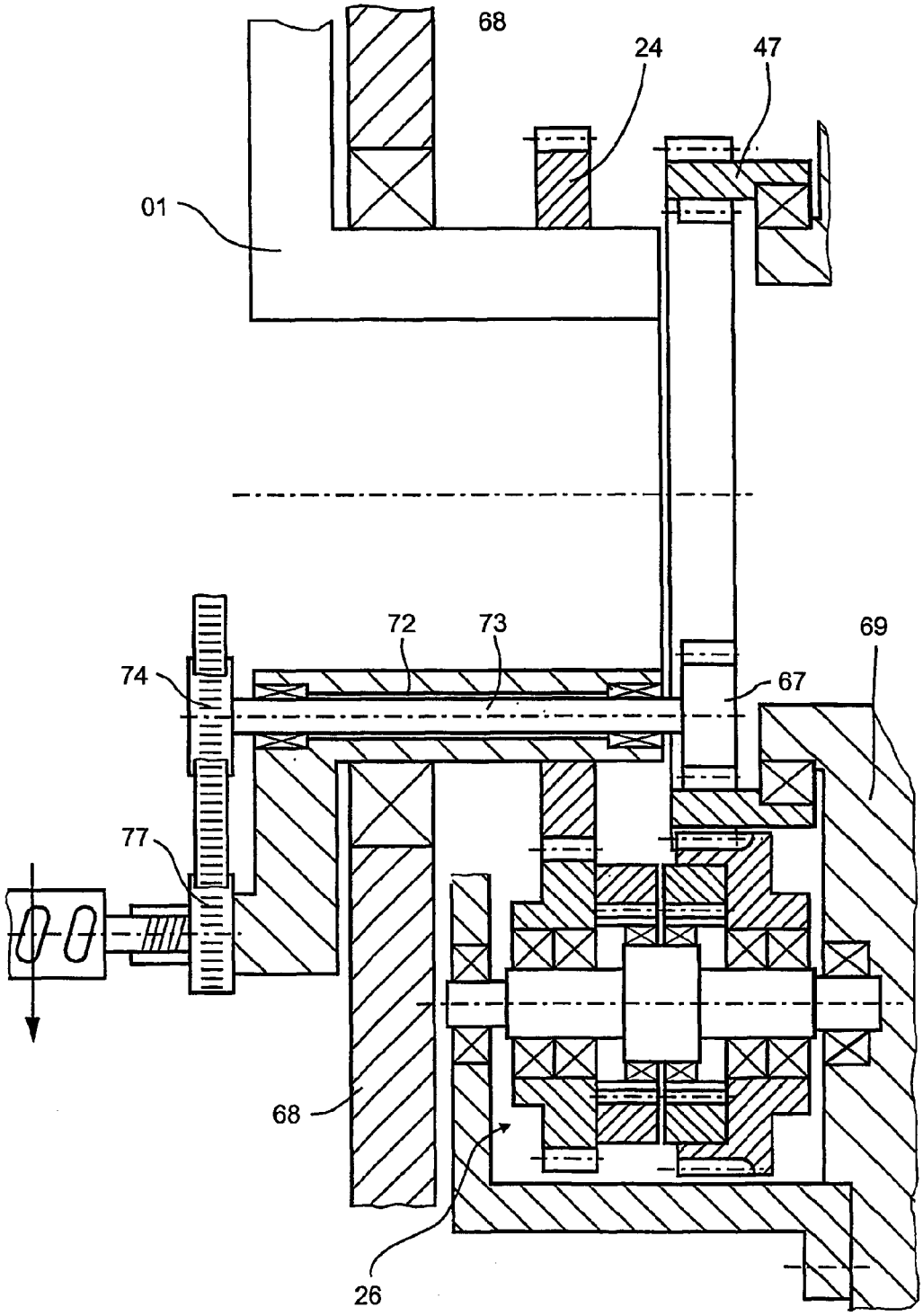

FIG. 14 shows a modification of the third embodiment of the invention. This modification differs from the embodiment shown in FIG. 12 by the attachment of the crown gear 47, which in FIG. 14 is rotatably seated not on the shaft section 71 of the folding cylinder 01, but instead coaxially with the folding cylinder 01 on the plate 69 that is located opposite to it. The mode of functioning of this modification does not differ from that of the embodiment in FIG. 12.

While preferred embodiments of a folding apparatus comprising a cylinder with an adjustable circumference, in accordance with the present invention have been set forth fully and completely hereinabove, it will be apparent to one of skill in the art that various changes in, for example the overall configuration of the printing device with which this folding apparatus is utilized, the type of material being folded, and the like could be made without departing from the true spirit and scope of the present invention which is accordingly to be limited only by the appended claims.

What is claimed is:

1. A folding apparatus comprising:

a cylinder;

a cylinder gear wheel;

means supporting said cylinder for rotation about a cylinder axis of rotation in a frame;

a cylinder shell surface including at least one hoop extending in a circumferential direction of said cylinder shell surface, said at least one hoop being supported for displacement with respect to said cylinder shell surface;

an adjusting gear assembly for displacement of said at least one hoop, said adjusting gear assembly including first and second stages, each of said first and second stages having a flexible toothed sleeve, said first and second flexible toothed sleeves of said first and second stages of said adjusting gear assembly being connected to each other;

a flexible toothed sleeve support shaft having an elliptical section, said elliptical section being adapted to deform said first and second flexible toothed sleeves of said first and second stages of said adjusting gear assembly;

a drive mechanism for said flexible toothed sleeve support shaft;

a first internally geared wheel in said first stage, said first internally geared wheel having internal teeth meshing with said first flexible toothed sleeve and having external teeth engaging said cylinder gear wheel; and a second internally geared wheel in said second stage, said second internally geared wheel having internal teeth meshing with said second flexible toothed sleeve and having external teeth connected to said at least one hoop.

2. The folding apparatus of claim 1 including a blade cylinder and further including first and second drive trains originating at said blade cylinder, one of said first and second drive trains driving said cylinder, the other of said first and second drive trains driving said first and second internally geared wheels.

3. The folding apparatus of claim 1 including a first drive train for said cylinder and a second drive train for at least one of said first and second internally geared wheels, and further including a cylinder cover disk with a cover disk drive train, said cylinder drive train, said at least one of said first and second internally geared wheel drive train and said cover disk drive train having at least one common element.

4. The folding apparatus of claim 1 further including eccentrics connecting said at least one hoop and said second internally geared wheel.

5. The folding apparatus of claim 1 further including a drive mechanism for said adjusting gear assembly and being rigidly connected with said elliptical section of said flexible toothed sleeve support shaft, said second internally geared wheel of said second stage engaging an exterior tooth arrangement of a crown gear, said crown gear being adapted to displace said at least one hoop.

6. The folding apparatus of claim 1 wherein at least one of said first and second internally geared wheels is coupled to said cylinder for rotation.

7. The folding apparatus of claim 1 further including a cylinder cover disk having a cylinder cover disk drive train and a drive train for said first internally geared wheel, said cylinder cover disk drive train and said first internally geared wheel drive train including common elements.

8. The folding apparatus of claim 1 wherein tooth members of said first and second internally geared wheels and of said first and second flexible toothed sleeves are situated such that said first and second internally geared wheels rotate at the same speed when said drive mechanism for said flexible toothed sleeve support shaft is stopped.

9. The folding apparatus of claim 1 wherein said first and second flexible toothed sleeves have identical tooth numbers and said inner teeth of said first and second internally geared wheels have differing tooth numbers.

10. The folding apparatus of claim 9 wherein said outer teeth of said first and second internally geared wheels have identical tooth numbers and further wherein said inner teeth of said first and second internally geared wheels have a ratio.

11. The folding apparatus of claim 1 wherein said first and second internally geared wheels have identical tooth numbers and further wherein said first and second flexible toothed sleeves having different tooth numbers.

12. The folding apparatus of claim 11 wherein said outer teeth of said first and second internally geared wheels have identical tooth numbers and wherein said first and second flexible toothed sleeves have a tooth ratio, and further including gear wheels coaxial with said cylinder and having the same tooth ratio as said first and second flexible toothed sleeves.

13. The folding apparatus of claim 1 wherein said cylinder gear wheel is coaxial with said cylinder.

14. The folding apparatus of claim 13 wherein said cylinder gear wheel is rotatably mounted on said cylinder.

15. The folding apparatus of claim 13 further including a lateral frame and wherein said cylinder gear wheel is rotatably mounted on said lateral frame.

16. The folding apparatus of claim 1 wherein said cylinder gear wheel is a crown gear.

17. The folding apparatus of claim 16 wherein said adjusting gear assembly engages an interior tooth arrangement of said crown gear.

18. The folding apparatus of claim 16 wherein said adjusting gear assembly engages an exterior tooth arrangement of said crown gear.

19. The folding apparatus of claim 1 further including eccentrics connecting said adjusting gear assembly and said at least one hoop.

20. The folding assembly of claim 1 further including a hoop adjusting strip supported in said cylinder for movement in a direction of said cylinder axis of rotation, said strip having at least one cam face engagable with said at least one hoop, said at least one cam face being oblique to said cylinder axis of rotation, said adjusting gear assembly being connected to said hoop adjusting strip.

21. The folding apparatus of claim 1 further including a drive belt mechanism connecting said adjusting gear assembly and said at least one hoop.

22. The folding apparatus of claim 1 wherein said cylinder is a folding cylinder.

* * * * *